United States Patent [19]

Bosland

[11] 3,937,239

[45] Feb. 10, 1976

[54] TIME DELAY MECHANISM FOR PENCIL SHARPENER

[75] Inventor: James M. Bosland, Wayne, N.J.

[73] Assignee: Ketcham & McDougall, Inc., Roseland, N.J.

[22] Filed: Mar. 19, 1975

[21] Appl. No.: 559,908

[52] U.S. Cl. ..... 144/28.5

[51] Int. Cl.[2] ..... B43L 23/02

[58] Field of Search... 144/28.1, 28.4, 28.5, 28.6–28.9

[56] References Cited

UNITED STATES PATENTS 2,408,767 10/1946 Fleming ..... 144/28.5

2,822,781 2/1958 Burton ..... 144/28.5

*Primary Examiner*—Othell M. Simpson

*Attorney, Agent, or Firm*—Darby & Darby

[57] ABSTRACT

A time delay mechanism positioned in the pencil sharpener housing near the entry point of the pencil delays the entry of the pencil into the sharpening cavity and simultaneously moves the helical cutting mechanism inwardly into engagement with a leaf spring contact thereby causing actuation of the pencil sharpener motor and rotation of the helical cutting mechanism before the entry of the pencil point into the sharpening cavity.

10 Claims, 4 Drawing Figures

TIME DELAY MECHANISM FOR PENCIL SHARPENER

BACKGROUND OF THE INVENTION

Automatic pencil sharpeners having helical blades and being driven by alternating current are generally actuated by a switch positioned in the sharpener housing near the entry point of the pencil to be sharpened. In operation, the pencil contacts the switch which actuates the motor thereby causing the helical blades to turn and the pencil to be sharpened. Since most alternatingcurrent type motors in automatic pencil sharpeners heretofore available have a low starting or initial torque, it is necessary to position the switch within the sharpener housing near the entry point of the pencil point so that the helical cutting blades are actuated before the resistance of the pencil point is encountered by the helical cutting blades. In this way, the helical cutting blades are actuated without any resistance being offered by the pencil and have sufficient time to develop a cutting torque sufficient to sharpen the point of the pencil when the pencil is pushed past the switch position and into the cutting or sharpening chamber. Because the switch is positioned in the housing near the entry point of the pencil to be sharpened, safety requirements mandate that the wires leading from the switch to the alternating current motor be double-insulated in order to prevent the user from being inadvertently shocked or electrocuted.

Direct-current actuated or battery-operated automatic pencil sharpeners generally have rotating-straight blade type cutting mechanisms rather than helical blade-cutting mechanisms. This is because it has not been practical to use a helical type cutting mechanism in this type of pencil sharpener because of the problem in overcoming starting resistance when a pencil is inserted against the pencil sharpener cutting member.

SUMMARY OF THE INVENTION

The time delay mechanism of this invention eliminates the need for positioning a switch in the pencil sharpener housing near the entry point of the pencil to be sharpened and hence eliminates the need for providing double-insulated wires leading from the entry point of the pencil sharpener housing to the alternating-current motor.

This invention also permits the use of a helical cutting blade mechanism in a direct-current actuated automatic pencil sharpener.

Briefly, this invention provides a time delay mechanism positioned in the pencil sharpener housing near the entry point of the pencil to be sharpened which cooperates with a movable helical cutting mechanism which, in turn, actuates a leaf spring positioned directly adjacent the pencil sharpener motor. In operation, when a pencil is inserted into the pencil sharpener housing to be sharpened, the time delay mechanism frictionally engages the pencil and slightly impedes the insertion of the pencil into the sharpener. This results in the time delay mechanism being moved inwardly into engagement with the movable cutting mechanism which in turn is moved inwardly so that a leaf spring contact or other switch type which is engaged by the cutting mechanism closes against a corresponding contact or switch to actuate the pencil sharpener motor. By the time the pencil to be sharpened is inserted through the time delay mechanism and into the helical cutting blade chamber, the motor has already been actuated and, hence, the helical cutting mechanism has been actuated without any resistance from the pencil to be sharpened. Thus, when the pencil to be sharpened enters the helical cutting chamber, the helical cutting mechanism is already rotating and has built up sufficient torque to overcome the resistance offered by the insertion of the pencil tip into the cutting chamber.

The time delay mechanism of this invention comprises an expandible ring member. When a pencil is initially placed in the ring member and pushed inwardly, the frictional force produced by the insertion of the pencil through the ring causes a momentary time delay in the travel of the pencil through the ring and the frictional force produced causes the ring to move inwardly with the pencil into engagement with the movable cutting mechanism, thereby actuating the motor.

Structural features and the complete nature of the time delay mechanism of this invention will become apparent from the ensuing specification and the appended claims in which the invention is defined, particularly when taken in conjunction with the accompanying illustrative drawings which set forth a preferred embodiment of the invention.

DESCRIPTION OF A PREFERRED EMBODIMENT

Figure 1:
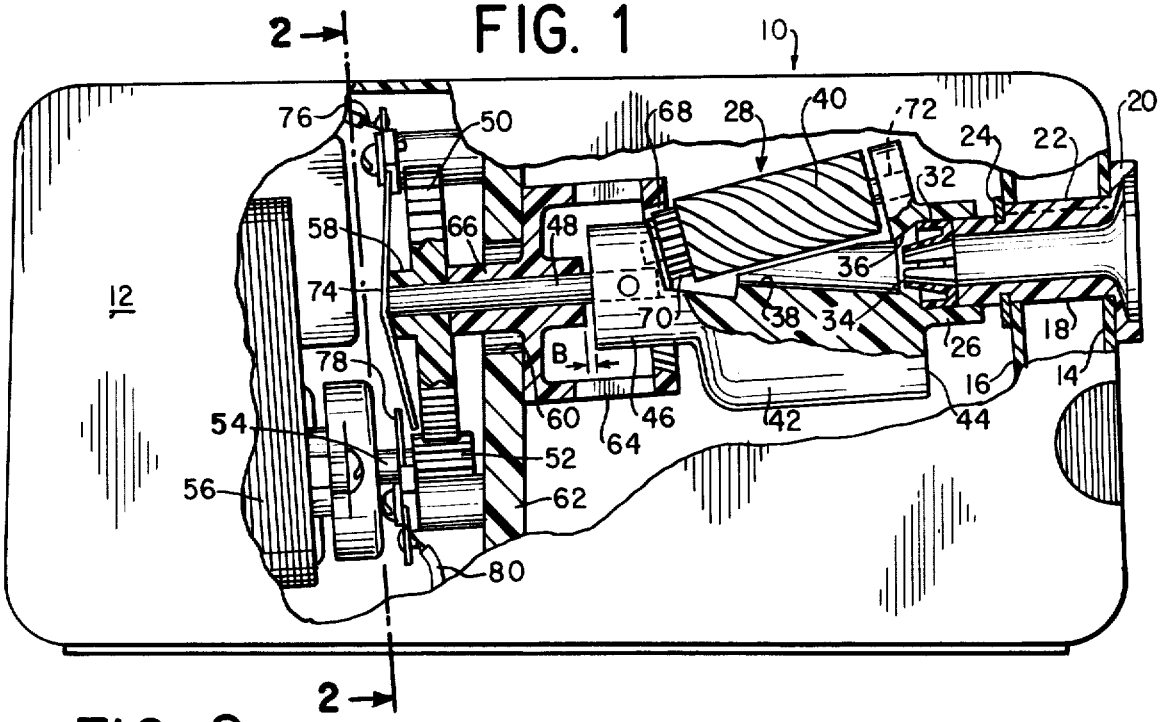
FIG. 1 is a side elevational view with parts cut away showing the time delay mechanism of this invention in an automatic pencil sharpener.

Referring now to FIG. 1, the pencil sharpener 10 is encased within a housing 12. Starting from the front of the pencil sharpener, an aperture with a keyway is formed in the double front walls 14 and 16 of the pencil sharpener housing. A tubular member 18 having a generally cylindrical shoulder 20 is fitted within the apertures in the double front wall 14 and 16. A ridge 22 which fits within the above-referred-to keyway is formed on the outer surface of the tubular member 18. A retaining ring 24 or C-clamp fits within a corresponding groove on the outer surface of the tubular member 18 and bears against the inner side of housing wall 16 so as to prevent the tubular member 18 from being pulled out of the housing. The shoulder member 20 which bears against the outer surface of the housing front wall 14 prevents the tubular member 18 from being pushed into the housing.

Throughout this application, the movement into the pencil sharpener is referred to as "movement inwardly" and movement out of the pencil sharpener is referred to as "movement outwardly". Similarly, surfaces of the various elements will be referred to as being "inner" or "outer" depending on their relative positions with respect to the innermost portion of the pencil sharpener.

Proceeding further inwardly along the pencil sharpener illustrated in FIG. 1, a cylindrical housing 26 is formed on the outermost portion of the cutting mechanism generally designated by reference numeral 28. The cylindrical housing 26 fits over the innermost or end portion of tubular member 18. Ring member 30 is positioned within the cylindrical housing 26 and the end of tubular member 18.

Figure 3:
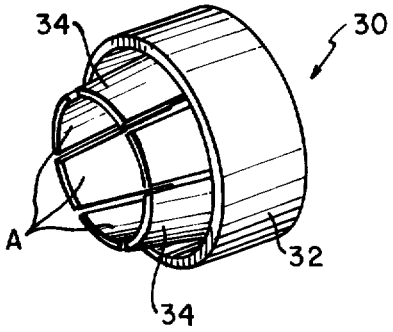
FIG. 3 is a perspective view of the expandible ring also illustrated in FIG. 1.
Figure 4:
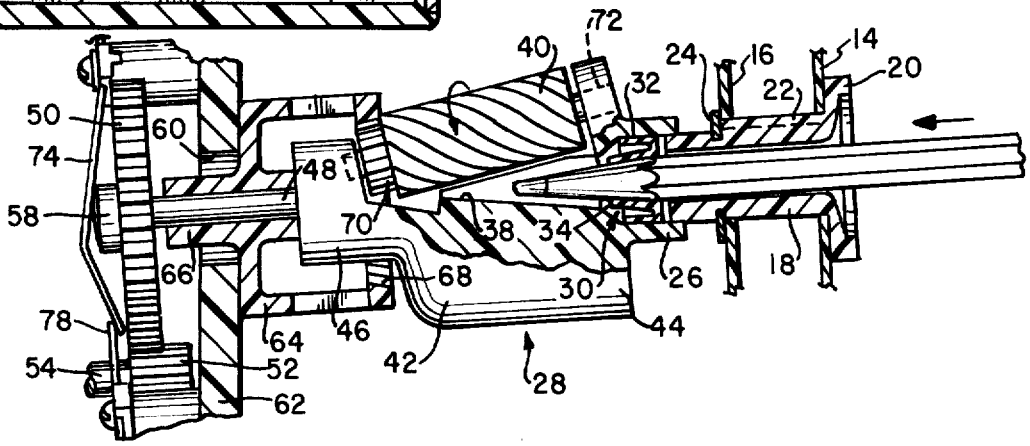
FIG. 4 is a view similar to FIG. 1 but showing a pencil inserted in the pencil sharpener.

Ring member 30 which is illustrated in detail in FIG. 3 includes a generally cylindrical outer ring 32 and a plurality of legs 34 which are flexibly attached to the inside surface of ring 32 and which form a frustoconical member. The ring legs 34 are each spaced from one another. The ring member 30 is formed so that a standard pencil, such as the MONGOL 482 pencil manufactured by Eberhard Faber Pen & Pencil Co., Inc., fits within the ring member 30 and causes the ring member legs 34 to expand outwardly as the pencil is pushed through the ring. The diameter of the base of the frustoconical element is slightly greater than the diameter of a standard pencil and the diameter of the apex of the frustoconical element is slightly less than the diameter of a standard pencil. It is noted that standard pencils, such as the above-referred-to pencil, are often hexagonally shaped. Thus, the six sides of a standard pencil can each engage one of the six legs 34 of the ring member 30 illustrated in FIG. 3. In the preferred embodiment, the pencil-engaging surfaces (marked A in FIG. 3) of the ring legs 34 have a concave shape to more smoothly engage the pencil which is inserted into the ring member in the event that the six outer edges of a standard pencil engage the ring leg surfaces A rather than fitting between the spaces between the ring legs 34. This, of course, depends upon the manner in which the pencil is inserted into the pencil sharpener — either with the flat surface of the pencil side engaging surface A or with the edge of the pencil engaging the surface A.

Proceeding further inwardly in the apparatus illustrated in FIG. 1, a countersunk cavity 36 is formed inwardly from the cylindrical cavity 26 of the cutting mechanism 28. The edge 38 of ring 32 bears against the surface forming the countersunk cavity 36.

Inwardly past the countersunk cavity 36, a generally cone-shaped cavity 38 is formed. It is in cone-shaped cavity 38 that the actual sharpening of the pencil takes place, as described below.

The cutting mechanism 28 consists of a helical cutting blade 40 which is mounted for rotary movement in the cutting mechanism housing 42. Directly opposite the helical cutting mechanism 40 is a counterweight 44 which aids in the rotation of the cutting mechanism in a manner well known in the art.

One end of shaft 48 is journalled into the inner portion 46 of the cutter mechanism housing. The other end of shaft 48 is journalled into gear member 50. A projection 58 is formed on the inner surface of the gear member 50 and shaft 48 extends within projection 58.

Figure 2:
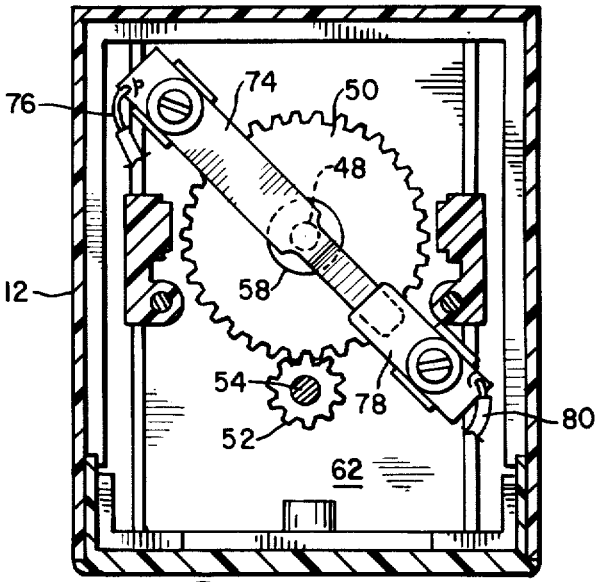
FIG. 2 is a cross-sectional view of the pencil sharpener illustrated in FIG. 1 taken along the lines 2—2.

Referring now to FIG. 2, gear member 50 is driven by gear 52 which is journalled onto the end of the output shaft 54 of the drive motor 56.

Referring again to FIG. 1, an aperture 60 is formed in a wall 62 which extends across the middle region of the pencil sharpener housing. A gear cage housing 64 is fastened to the wall 62. Shaft 48 extends through a tubular portion 66 of the gear cage housing and is rotatable and slidably movable within it.

A gear cage 68 is formed on the innermost end of the gear cage housing 64. The teeth of the gear cage 68 engage the teeth on gear 70 which is mounted adjacent the helical cutting blade 40. Gear 70 and helical cutting blade 40 are both journalled onto the shaft 72 which is freely rotatable within the cutting mechanism housing. Thus, rotation of the cutting mechanism housing in a counterclockwise direction by shaft 48 results in the helical cutting blade revolving in a clockwise direction because of the engagement of the gear teeth 70 with the gear cage 68.

Referring to FIGS. 1 and 2, a leaf spring 74 is attached to a protuberance from the inner surface of the wall 62 and an electrical lead 76 to the motor is in electrical contact with one end of the leaf spring. Another contact 78 is attached to another protuberance from the inner surface of the wall 62 and an electrical lead 80 to a power supply lead is in electrical contact with one end of the leaf spring. The free ends of the leaf spring contact 74 and contact 78 overlap one another but are spaced from one another so that no power is provided to the motor, as illustrated in FIG. 1, when a pencil is not in the pencil sharpener.

Referring to FIG. 3, when a pencil is inserted into the pencil sharpener, the pencil first engages the ring member 36. As the pencil is pushed further into the pencil sharpener, the outer ring edge 38 of the ring member 30 exerts a force on the surface of the countersunk cavity 36 thereby pushing the entire cutting mechanism rearwardly. This results in the shaft 48 moving inwardly within the gear cage housing tubular portion 66. The innermost end of the shaft 48 engages the leaf spring contact 74 and pushes it inwardly so that the free end of the leaf spring contact 74 engages the free end of the contact 78, thereby causing electrical power to be supplied to the motor. This, in turn, results in rotation of the motor output shaft 54 which drives gear 52 which in turn drives gear 50. Rotation of gear 50 causes rotation of shaft 48 and, consequently, the helical cutting mechanism 28. All this is accomplished before the end of the pencil can be inserted into the cutting cavity 38 so that there is no resistance offered by the pencil to be sharpened to the initial or start-up rotation of the helical gear mechanism 28. By the time the point of the pencil reaches the cutting cavity 38, the helical cutting mechanism 28 has already been actuated.

The distance (marked B in FIG. 1) between the end of the tubular portion 66 of the gear cage housing and the innermost end of the helical cutting mechanism is the critical distance which the cutting mechanism must move in order to actuate the leaf spring contact 74 into engagement with the contact 78.

When the pencil is removed from the cutting cavity, the force exerted by leaf spring contact 74 on shaft 48 causes the helical cutting mechanism to return to the position illustrated in FIG. 1.

Another feature of this invention is that the cylindrical housing 26 rotates about the ring member 30 which holds the pencil to be sharpened during the pencil-sharpening operation. Since ring member 30 can be composed of Teflon, it acts as a bearing surface and reduces the rotational friction when the pencil is held against rotation as is normal during the pencil-sharpening operation.

While the preferred embodiment of various aspects of this invention has been shown in the drawings, it is to be understood that this disclosure is for the purpose of illustration only and that various changes in shape, proportion and arrangement of parts, as well as the substitution of equivalent elements for those herein shown and described, may be made without departing from the spirit and scope of the invention as set forth in the appended claims. For example, devices of various configurations could be used to accomplish the function of ring member 30.

What is claimed is:

1. Apparatus for automatically sharpening a pencil comprising:

a sharpener housing having an outer end corresponding to the entry point of the pencil to be sharpened and an inner end, an electric motor being positioned within said housing adjacent said housing inner end, means for cutting the pencil, said cutting means being positioned within said sharpener housing between said electric motor and said sharpener housing inner end, a first electrical contact bein electrically connected to said motor and being positioned between said motor and said cutting means, a second electrical contact being adjacent to and spaced from said first electrical contact and being positioned between said motor and said cutting means, said cutting means being axially movable into engagement with said second electrical contact, means positioned adjacent the outer end of said housing for frictionally engaging the pencil to be sharpened, said frictionally engaging means being axially movable within said housing into engagement with said cutting means whereby insertion of the pencil into said frictionally engaging means causes axial movement of said engaging means, said cutting means and said second electrical contact thereby closing said normally separated electrical contacts and actuating said electrical motor.

2. The apparatus recited in claim 1, said frictionally engaging means comprising a ring member, said ring member having a plurality of flexible legs extending from the inner surface of said ring member, said flexible legs forming a frustoconical element.

3. The apparatus recited in claim 2, said ring member frustoconical element having a base diameter and an apex diameter, said base diameter being slightly greater than the diameter of a standard pencil, said apex diameter being slightly smaller than the diameter of a standard pencil.

4. The apparatus recited in claim 2, each of said flexible legs being spaced from one another, and the pencil engaging surface of each of said legs being concave.

5. The apparatus recited in claim 2, said cutting means comprising a cutting blade, a cutting blade housing in which said cutting blade is rotatably mounted, said blade housing having an inner end and an outer end corresponding to the inner and outer ends of said sharpener housing, a generally cylindrical chamber being formed on said blade housing outer end, said ring member being positioned within said blade housing cylindrical chamber.

6. The apparatus recited in claim 5, a countersunk cavity being formed in said blade housing inwardly from said blade housing cylindrical chamber, said ring member inner edge bearing against the surface of said blade housing countersunk cavity and means positioned adjacent said sharpener housing outer end for supporting said ring member in said blade housing cylindrical chamber.

7. The apparatus recited in claim 6, said sharpener housing having a front wall at said sharpener housing outer end, said ring member supporting means comprising a generally tubular element extending through an aperture in said sharpener housing front wall and into said blade housing cylindrical portion, the inner end of said tubular element bearing against said ring member.

8. The apparatus recited in claim 5, a support wall being located within said sharpener housing between said sharpener housing inner and outer ends, a gear cage housing being attached to said support wall, said gear cage housing including a tubular portion extending through an aperture in said support wall, a shaft being attached to said cutting blade housing outer end, said shaft extending through said gear cage housing tubular portion and being slidable within said tubular portion.

9. The apparatus recited in claim 8, a first gear being journalled onto said shaft, a second gear attached to the output of said motor being in driving engagement with said first gear, said shaft innermost end being contact with one of said electrical contacts.

10. The apparatus recited in claim 1, said first electrical contact comprising a leaf spring.

* * * * *